US006681809B2

(12) United States Patent
Savard et al.

(10) Patent No.: US 6,681,809 B2
(45) Date of Patent: Jan. 27, 2004

(54) DEVICE FOR BENDING AN EXTREMITY OF A TORSIONAL SPRING

(75) Inventors: Normand Savard, Drummondville (CA); Guillaume Allen, Saint-Anselme (CA); Philippe Larochelle, Drummondville (CA)

(73) Assignee: Canimex Inc., Quebec (CA)

( * ) Notice: Subject to any disclaimer, the term of this patent is extended or adjusted under 35 U.S.C. 154(b) by 0 days.

(21) Appl. No.: 10/153,002

(22) Filed: May 22, 2002

(65) Prior Publication Data

US 2003/0115928 A1 Jun. 26, 2003

(30) Foreign Application Priority Data

May 22, 2001 (CA) ..... 2348101

(51) Int. Cl.[7] ..... B21F 35/02
(52) U.S. Cl. ..... 140/103; 72/217
(58) Field of Search ..... 140/80, 103; 72/137, 72/216, 217, 218, 387, 388

(56) References Cited

U.S. PATENT DOCUMENTS

| | | | | |
|---|---|---|---|---|
| 1,076,109 A | * | 10/1913 | Foster | 140/103 |
| 1,633,416 A | | 6/1927 | Peraira et al. | |
| 1,880,606 A | * | 10/1932 | Vanderploeg | 140/103 |
| 2,934,100 A | | 4/1960 | Huber et al. | 140/102 |
| 3,964,736 A | | 6/1976 | Huhnen | 267/166 |

FOREIGN PATENT DOCUMENTS

| | | |
|---|---|---|
| DE | 929961 | 7/1955 |
| DE | 1101337 | 3/1961 |
| DE | 2353169 | 4/1975 |

* cited by examiner

*Primary Examiner*—Lowell A. Larson
(74) *Attorney, Agent, or Firm*—Merchant & Gould P.C.

(57) ABSTRACT

A device for bending an extremity of a torsional spring. The device includes a base plate; at least one flange projecting from the base plate; at least one bulge projecting from the at least one flange; a lever arm pivotally mounted onto the at least one flange about a first pivot axis; and at least one cam pivotally mounted onto the lever arm about a second pivot axis. The lever arm is operable between first and second positions and each cam has a contact surface being positioned for operatively cooperating with a corresponding bulge. Prior to the bending operation, the extremity of the torsional spring is inserted between a given bulge and the contact surface of a corresponding cam when the lever arm is in the first position. In operation, the extremity of the spring is bent about the given bulge by the contact surface of the corresponding cam when the contact surface is urged towards the bulge and forced about the same over the extremity of the spring as the lever arm is operated into the second position. The device enables an easier, simpler and more cost effective way of bending an extremity of a torsional spring, without the use of heat for bending the spring tail, and may be easily transportable from one site to another. Moreover, the device can be used for bending the extremities of torsional springs having different wire sizes.

20 Claims, 11 Drawing Sheets

DEVICE FOR BENDING AN EXTREMITY OF A TORSIONAL SPRING

FIELD OF THE INVENTION

The present invention relates to a device for bending an extremity of a torsional spring. More particularly, the present invention relates to a device for bending an extremity of a torsional spring so that said bent extremity of the spring may be used with a plug, such as the ones used for operatively connecting torsional springs to overhead shafts of counterbalancing mechanisms of garage doors and the like.

BACKGROUND OF THE INVENTION

It is known in the art that large, vertical, cable-operated doors, such as commercial and residential sectional garage doors, usually require counterbalancing mechanisms to counterbalance the weight of the door in order to decrease the force required to open the door and also facilitate its closing from a raised to a lowered position. Large sectional garage doors used in commercial and residential applications may be manually or power operated. In either case, but particularly for manually operated doors, counterbalancing mechanisms have been used for many years to counterbalance the weight of the door and control its opening and closing movements so that one person can easily control the operation of the door. Counterbalancing mechanisms are also advantageous for power operated overhead doors since they reduce the power requirements needed for the motor and they lower the structural strength required for the door opening and closing mechanism. In other words, lighter weight, lower cost, door controlling mechanisms may be used if a counterbalancing mechanism is connected to the door to assist it in its opening and closing movements. Furthermore, the provision of a counterbalancing mechanism minimizes the chance of a rapid and uncontrolled closing of the door in the event of a failure of the door opening and closing mechanism, which can result in serious injury or damage.

It is also known in the art that a widely used type of counterbalancing mechanism generally comprises a pair of spaced apart cable drums connected to flexible cables, each cable being in turn connected to a lower opposite side edge of the garage door. The cable drums are usually mounted on an overhead shaft which is supported above the door opening and is connected to one or more torsion springs which are each fixed to the shaft at one end, and secured to a fixed structure, such as the wall for example, at the other end, so that the cable drums are biased to rotate in a direction which winds the cables onto the drums and counteracts the weight of the door connected to the cables. The torsion springs are adjusted to properly balance the weight of the door so that minimal opening and closing efforts are required, either manually or when motor controlled.

It is also known in the art that conventional, low cost adjustment devices used for the above-mentioned type of counterbalance mechanism, and widely utilized in the garage door industry, are generally cylindrical "collars" commonly referred to also as "plugs" (or "cones") which are connected to the so-called fixed ends of the torsion springs and are thus mounted on the aforementioned shaft for adjusting the deflection of the springs to preset the counterbalance force. The aforementioned plugs usually include one or more setscrews which lock the plugs to the shaft to prevent rotation thereabout except during normal adjustment of the spring deflection. The plugs also usually include sockets for receiving winding bars whereby the springs are manually preset, or "preloaded", by rotating the plugs with respect to the shaft using the winding bars and then locking the plugs to the shaft with the setscrews. Each plug may also include a slot onto which a corresponding bent free end of the torsion spring is hooked on. These slots are usually T-shaped, and are thus commonly known as "T-slots". An example of a known winding plug is shown in FIG. 11.

Typically, the shape of the slots of the plugs known in the art allows the introduction of the spring's tail without the use of any tool. Once the spring tail is introduced into the slot of the plug, both the plug and the spring are then introduced onto a shaft and installed on site, after which the plug is pushed towards the spring and then rotated around the spring axis in order to have the spring tail blocked there by the slot of the plug. The combined slot and shaft hold the assembly together without any other accessories. An example of a conventional torsional spring hooked onto a known winding plug mounted onto a shaft of a counterbalancing mechanism according to the prior art is shown in FIG. 12.

An important problem associated with the aforementioned type of counterbalancing mechanism, or with any other type of counterbalancing mechanism which uses plugs for operatively connecting torsional springs to overhead shafts of counterbalancing mechanisms, is that the plugs require the torsional springs to have bent extremities which act as "hooks" so as to be able to be mounted onto the slots of said plugs, i.e. so as to be able to be hooked onto the plugs. Therefore, it would be useful to provide a device would be able to bend an extremity of a torsional spring so that said bent extremity of the spring may be used with a plug of a counterbalancing mechanism.

Another important problem associated with the aforementioned type of counterbalancing mechanism, or with any other type of similar counterbalancing mechanism, is that the spring tail often requires to be bent in a particular manner, generally towards the center axis of the torsional spring and with the bent portion having a certain length, so as to be able to properly cooperate with a given plug of the counterbalancing mechanism. Therefore, it would be useful to provide a device which, by virtue of its design and components, would enable to bend an extremity of a torsional spring in a particular manner so that the bent extremity may properly cooperate with a plug of a counterbalancing mechanism.

Yet another important problem associated with the aforementioned type of counterbalancing mechanism, or with any other type of similar counterbalancing mechanism, is that a garage door installer often has to change or adjust torsional springs on site but is not always equipped with the appropriate equipment necessary to suitably heat and bend the spring extremities of a torsional spring because this equipment is generally quite heavy to carry around and fairly elaborate to operate. Therefore, it would be useful to provide a device which, by virtue of its design and components, would enable an easier, simpler and more cost effective way of bending an extremity of a torsional spring. It would be also useful to provide a device for bending an extremity of a torsional spring, which would not require the use of heat for bending the spring tail, and which would be easily transportable from one site to another.

Another important problem known in the art is that different methods and devices are generally required to bend the extremities of torsional springs having different wire sizes, i.e. torsional springs made of wires whose diameters are different. Therefore, it would be very useful to provide to a single device which, by virtue of its design and components, would be able to bend the extremities of torsional springs having different wire sizes.

Hence, in light of the aforementioned, there is a need for an improved device for bending an extremity of a torsional spring destined to be employed with plugs of counterbalancing systems of garage doors and the like. There is also a need for a device which, by virtue of its design and components, would enable to bend an extremity of a torsional spring in a particular manner so that the bent extremity may properly cooperate with a plug of a counterbalancing mechanism. Furthermore, there is also a need for a device which, by virtue of its design and components, would provide an easier, simpler and more cost effective way of bending an extremity of a torsional spring. Moreover, there is also a need for a device for bending an extremity of a torsional spring, which would not require the use of heat for bending the spring tail, and which would be easily transportable from one site to another. Moreover, there is a need for a device which would enable to bend an extremity of a torsional spring in a more cost effective way than what is possible with what is known in the art. There is also an important need for a device which, by virtue of its design and components, would be able to bend the extremities of torsional springs having different wire sizes.

SUMMARY OF THE INVENTION

The object of the present invention is to provide a device for bending an extremity of a torsional spring, which satisfies some of the above-mentioned needs and which is thus an improvement over the devices known in the prior art.

In accordance with the present invention, the above object is achieved with device for bending an extremity of a torsional spring, the device comprising:

a base plate;

at least one flange projecting from the base plate;

at least one bulge projecting from the at least one flange;

a lever arm pivotally mounted onto the at least one flange about a first pivot axis, the lever arm being operable between first and second positions; and at least one cam pivotally mounted onto said lever arm about a second pivot axis, said at least one cam having a contact surface being positioned for operatively cooperating with said at least one bulge;

wherein the extremity of the torsional spring is inserted between the at least one bulge and the contact surface of the at least one cam when the lever arm is in the first position; and wherein said extremity is bent about the at least one bulge by the contact surface of the at least one cam when said contact surface is urged towards said at least one bulge and forced about the same over the extremity as the lever arm is operated into the second position.

Preferably, each cam is eccentrically mounted about the second pivot axis.

Preferably also, the lever arm is provided with a slot for receiving a winding bar.

Preferably also, the device comprises first and second flanges projecting from the base plate, the lever arm being pivotally mounted between said flanges about a shaft extending through corresponding bores provided on the flanges.

Preferably also, the shaft has first and second ends protruding from the first and second flanges respectively, said first and second ends acting as first and second bulges; and wherein the device comprises first and second cams, each of said cams being pivotally mounted on either side of the lever arm about a shaft extending through a corresponding bore provided on the lever arm, the first and second cams having each a contact surface being positioned for operatively cooperating with the first and second bulges respectively.

Preferably also, the cams are provided with biasing means for maintaining the cams in a biased position with respect to the lever arm.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

Figure 1:
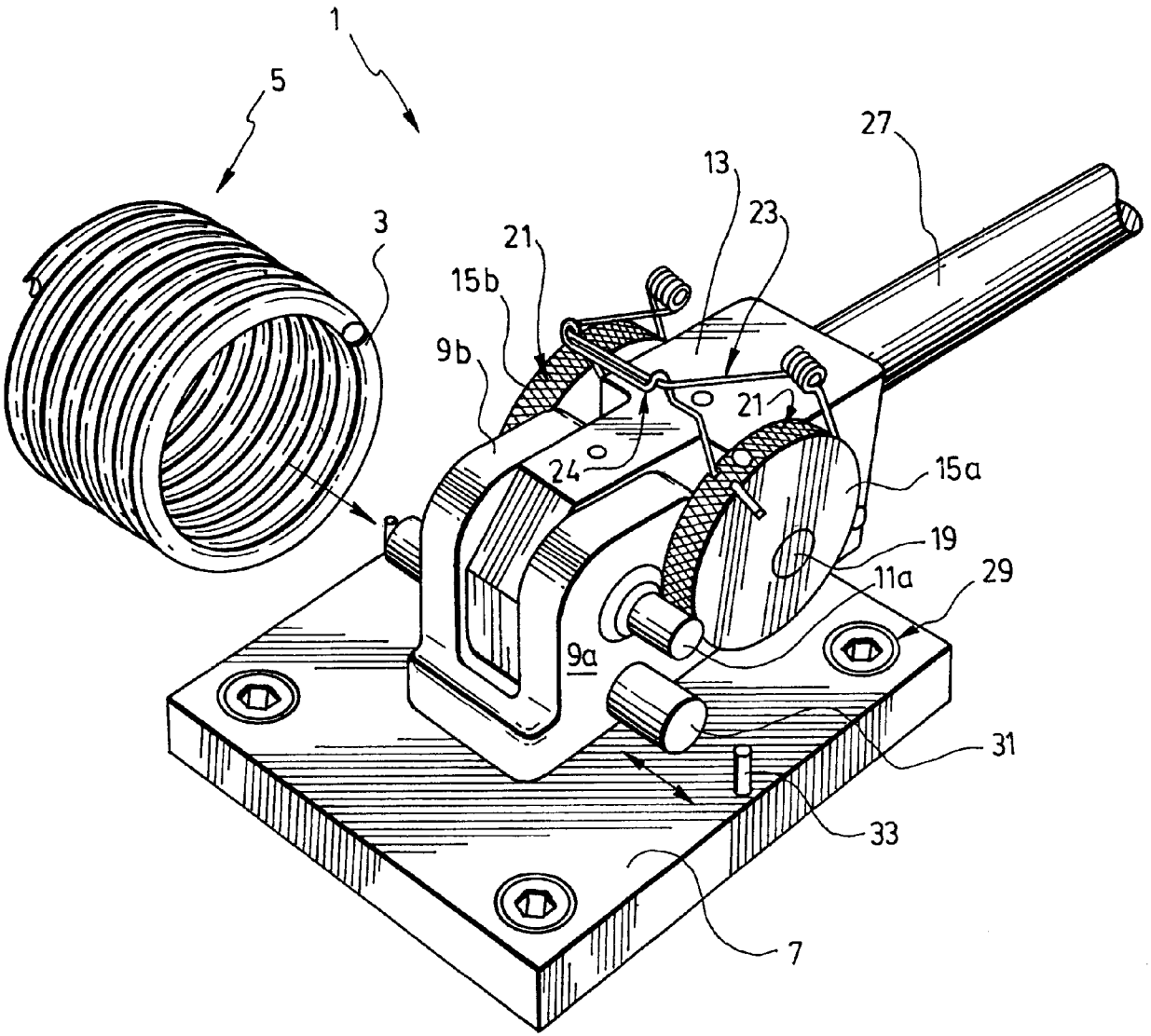
FIG. 1 is a top perspective view of the device according to the preferred embodiment of the invention, the device being shown with its lever arm in the first position and provided with a winding bar, the device being further shown with a torsional spring in an exploded relationship therewith prior to the bending of the extremity of said torsional spring.
Figure 2:
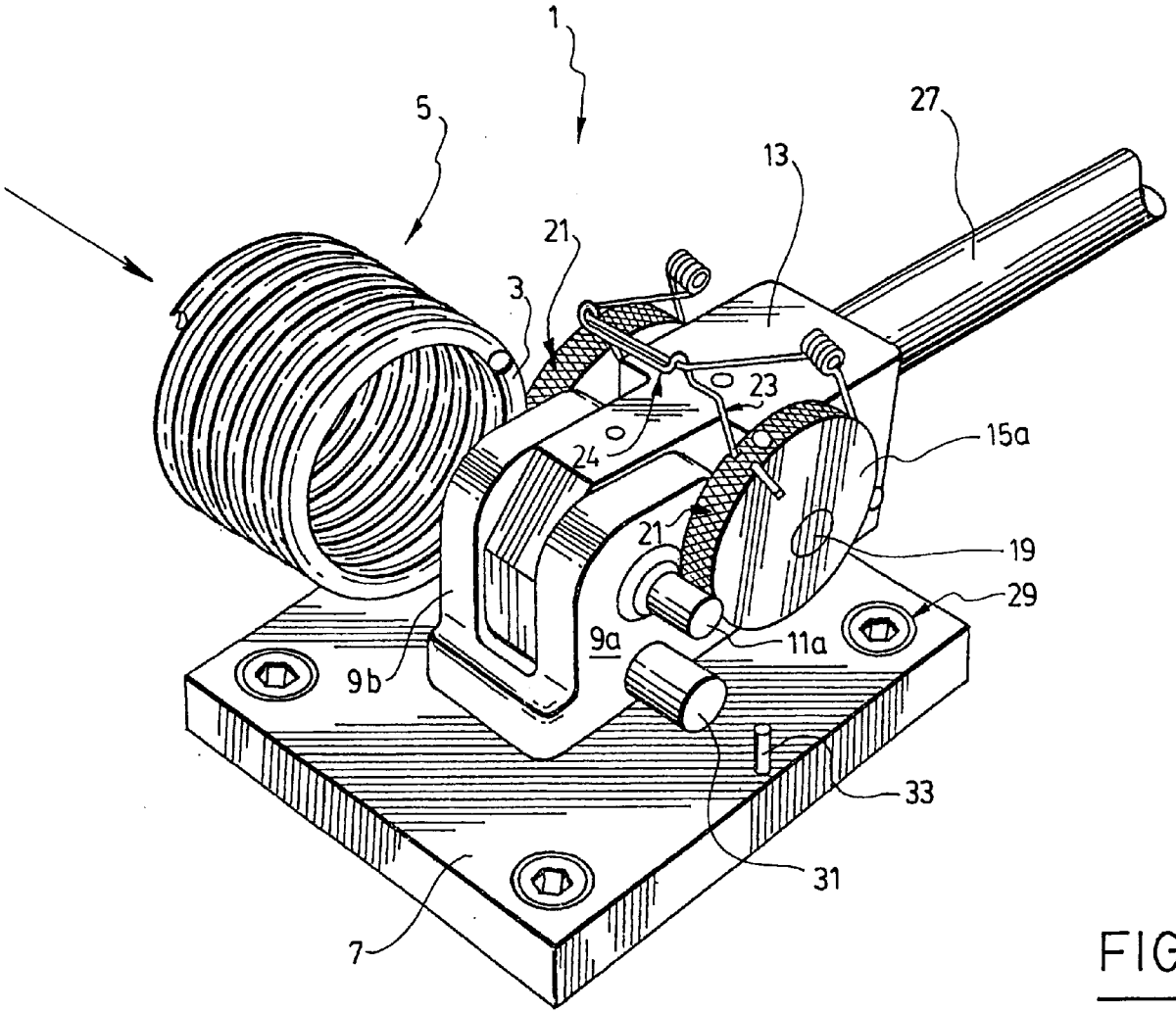
FIG. 2 is another perspective view of what is shown in FIG. 1, the torsional spring being shown now mounted onto the device prior to the bending of the extremity of the torsional spring.
Figure 3:
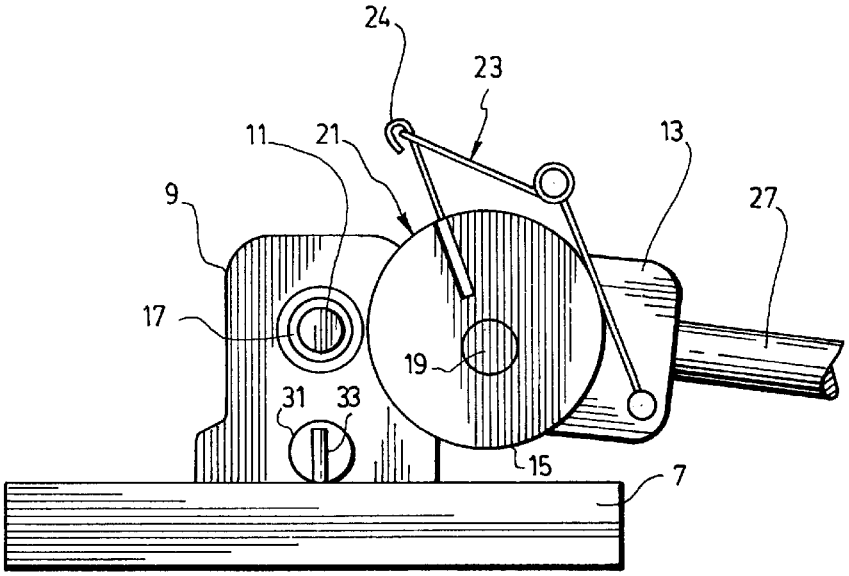
FIG. 3 is a schematic side view of the device shown in FIG. 1, said device being shown with its lever arm in the first position, said lever arm being shown provided with a winding bar inserted into a rear slot thereof.
Figure 4:
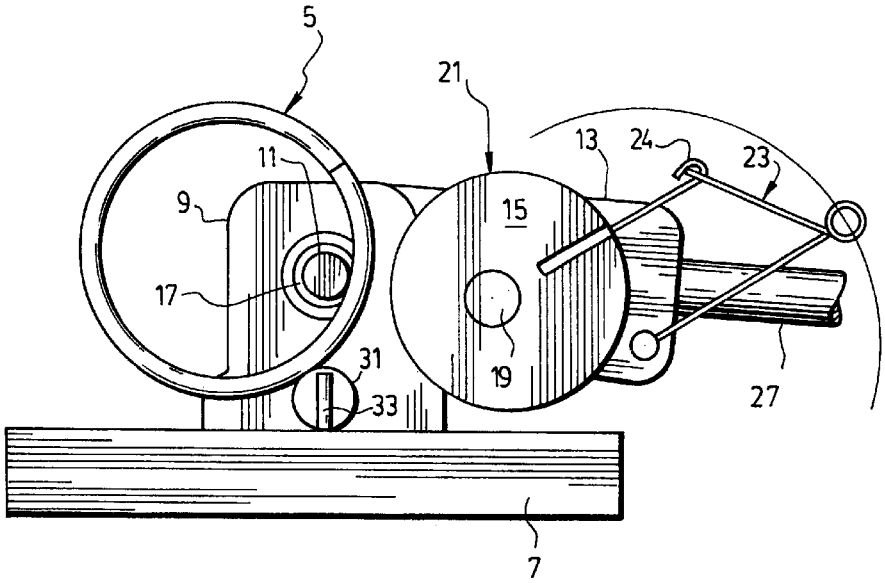
FIG. 4 is a schematic fragmentary side view of what is shown in FIG. 3, the device being shown now with the biasing means drawn back and with a torsional spring mounted thereon.
Figure 5:
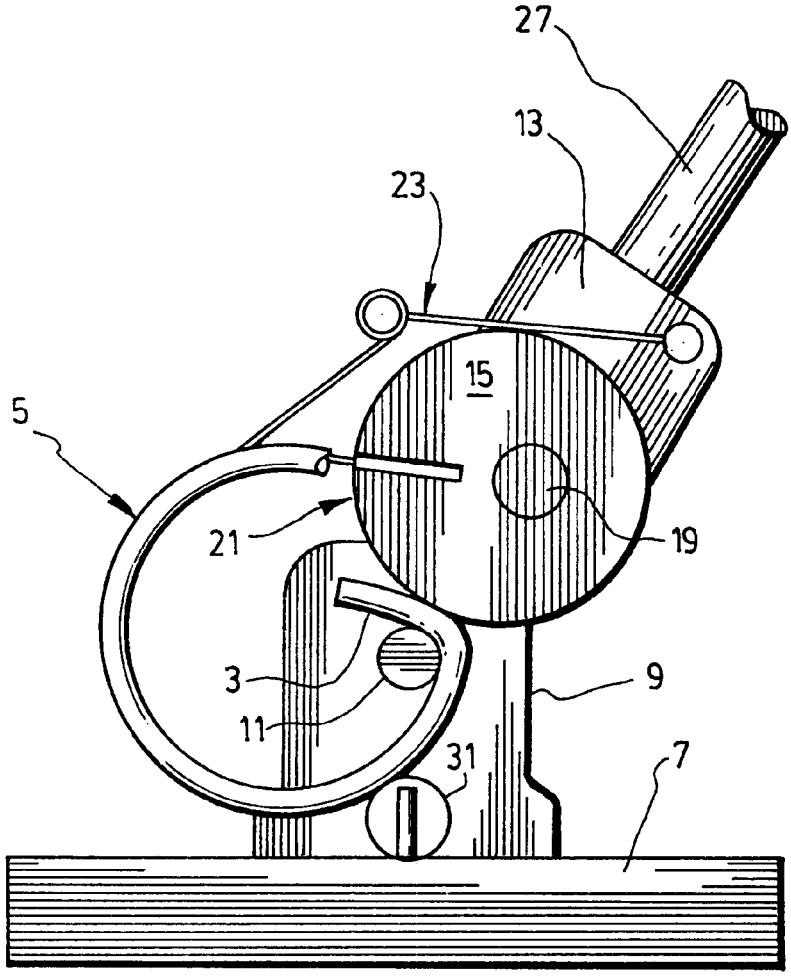
FIG. 5 is another schematic fragmentary side view of what is shown in FIG. 4, the device being shown now with the biasing means having been released and with the lever arm triggered towards the second position thereby bending the extremity of the torsional spring mounted thereon.
Figure 6:
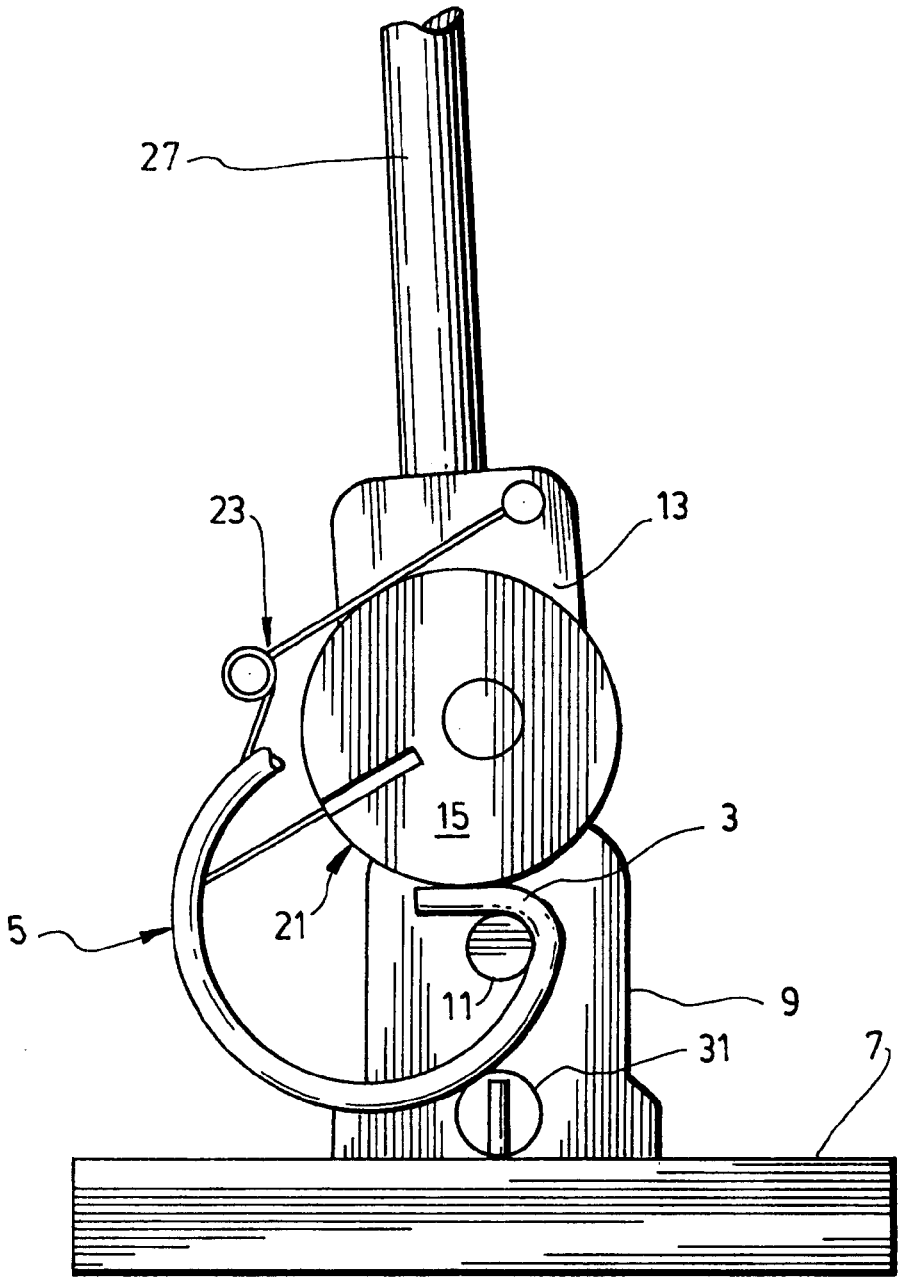
FIG. 6 is another schematic fragmentary side view of what is shown in FIG. 5, the device being shown now with its lever arm in the second position and the extremity of the torsional spring being bent.
Figure 7:
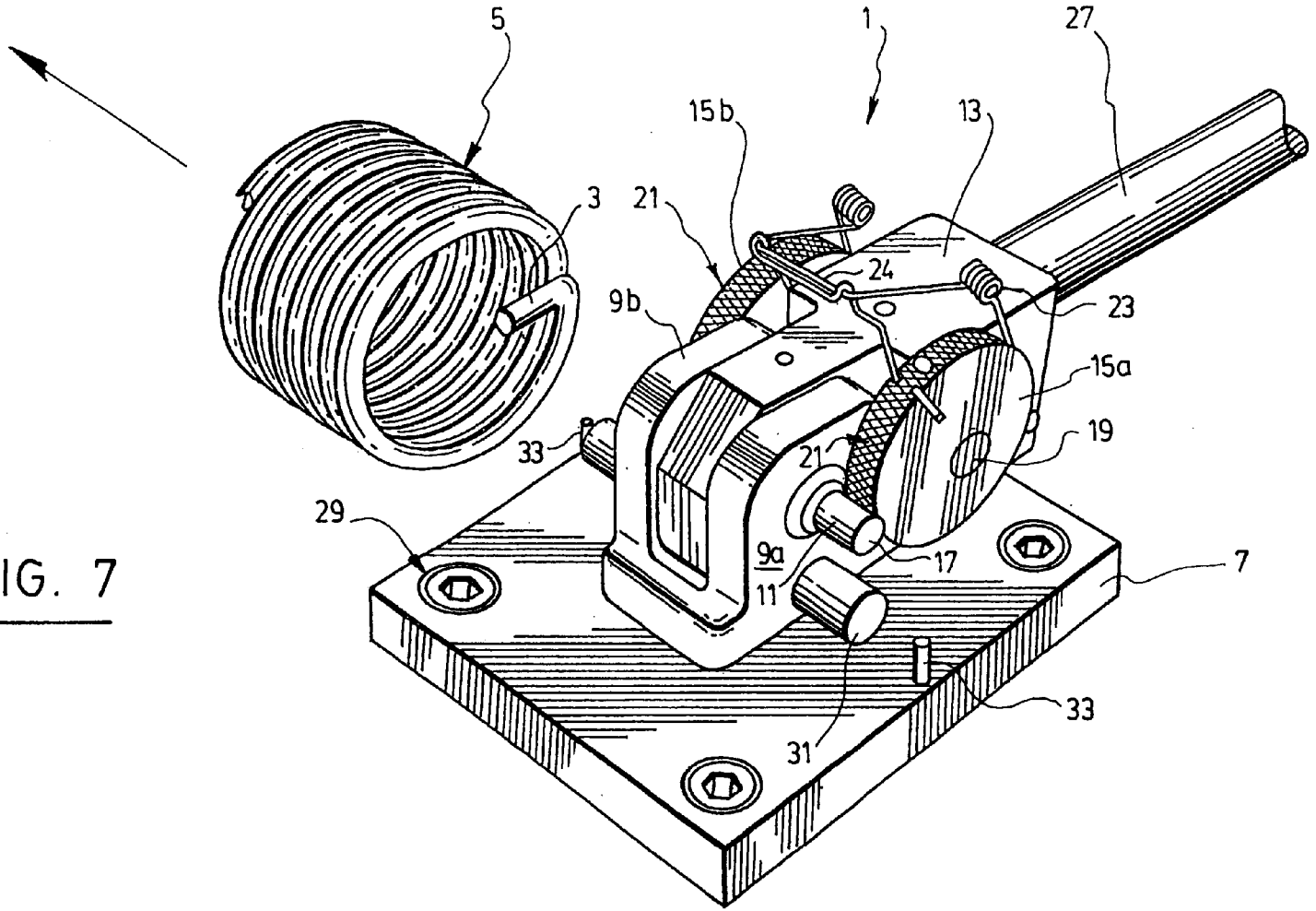
FIG. 7 is another top perspective view of what is shown in FIG. 1, the torsional spring being shown now removed from the device after its extremity has been bent.
Figure 8:
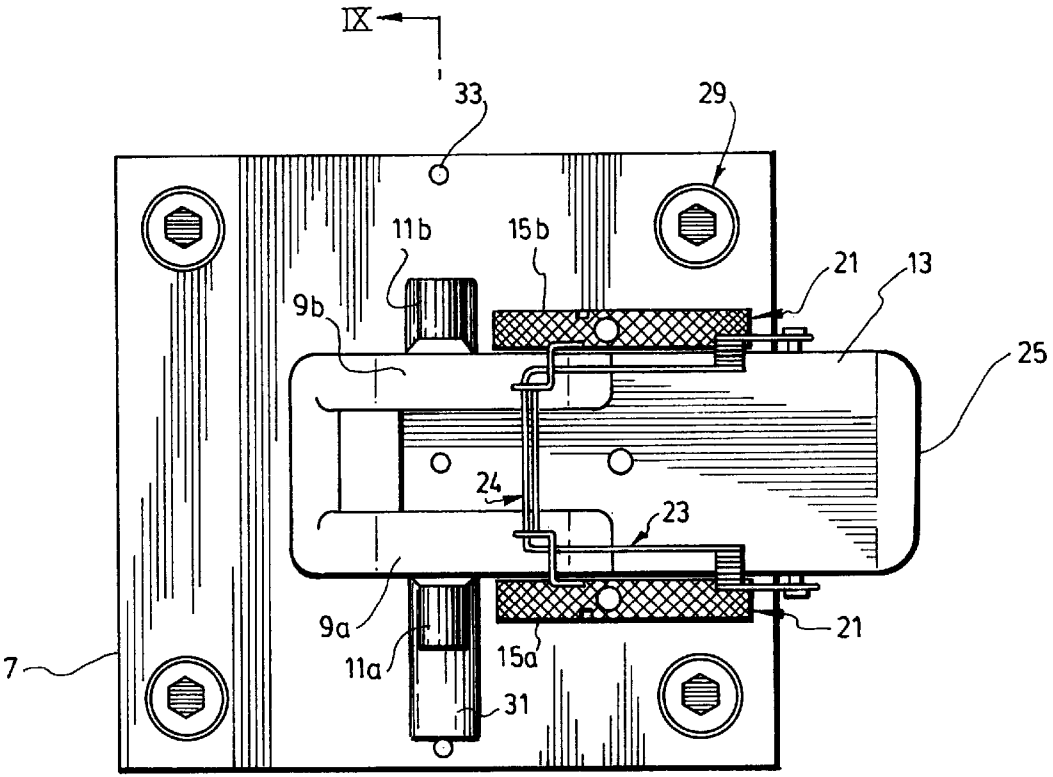
FIG. 8 is a top plan view of the device shown in FIG. 1, the device being shown without a winding bar and with its pin rested against a stopper of the base plate.
Figure 9:
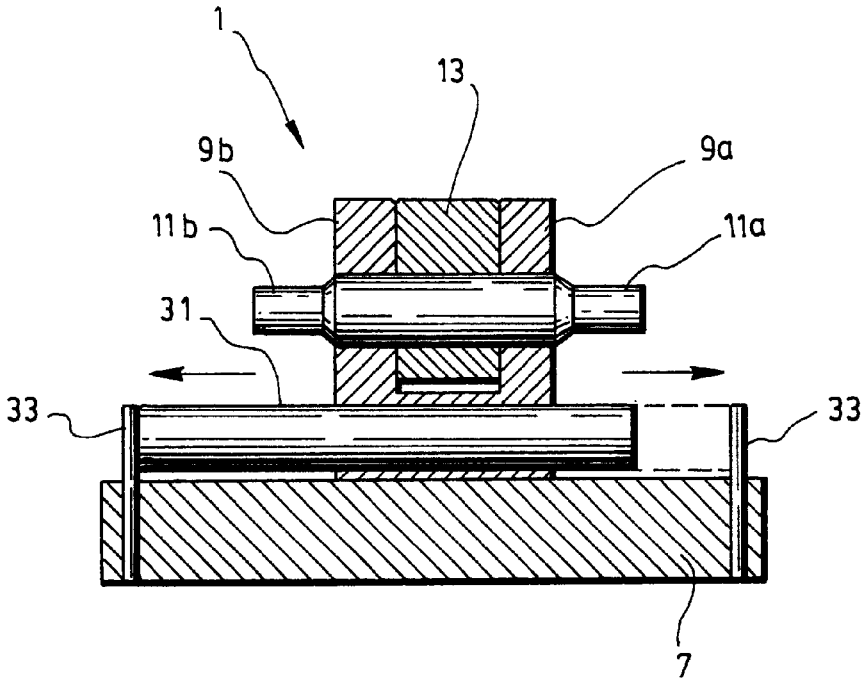
FIG. 9 is a cross-sectional view taken along line IX—IX of the device shown in FIG. 8.

In the following description, the same numerical references refer to similar elements. The embodiments shown in the figures are preferred.

Furthermore, although the present invention was primarily designed for bending an extremity of a torsional spring to be used with a counterbalancing mechanism of a garage door, it may be used for bending extremities of other types of springs used in other technical fields, as apparent to a person skilled in the art. For this reason, expressions such as "garage door", "plug", "torsional" and the like should not be taken as to limit the scope of the present invention and include all other kinds of springs or items with which the present invention may be used and could be useful.

Moreover, in the context of the present invention, the expressions "tail", "end", "extremity", and any other equivalent expression known in the art used to designate the latter part of a spring, as well as any other equivalent expressions and/or compound words thereof, may be used interchangeably. Furthermore, expressions such as "torsion" and "torsional", may also be used interchangeably in the context of the present description. The same applies for any other mutually equivalent expressions such as "plug" and "collar", as also apparent to a person skilled in the art.

In addition, although the preferred embodiment of the present invention as illustrated in the accompanying drawings comprises various components such a sliding pin, stoppers, holes, bores, shafts, biasing means, knurled contact surfaces, etc., and although the preferred embodiment of the present invention as shown consists of certain geometrical configurations such as the cams being "eccentrically" mounted about the second pivot axis, etc., not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the device according to the present invention, as will be explained hereinafter, without departing from the scope of the invention.

Broadly described, the device 1 according to the present invention, as illustrated in the accompanying drawings, is a device 1 for bending an extremity 3 of a torsional spring 5. The device 1 comprises a base plate 7; at least one flange 9 projecting from the base plate 7; at least one bulge 11 projecting from the at least one flange 9; a lever arm 13 pivotally mounted onto the at least one flange 9 about a first pivot axis; and at least one cam 15 pivotally mounted onto said lever arm about a second pivot axis.

Preferably, the first pivot axis comprises a shaft 17 extending through a corresponding bore provided on each flange 9, and the second pivot axis comprises another shaft 19 extending through a corresponding bore provided on the lever arm 13. Preferably also, each cam 15 is circular and is eccentrically mounted about the second pivot axis, as better shown in FIGS. 3–6. It is worth mentioning though that, according to the present invention, each cam 15 may take on other suitable shapes and may be mounted onto the lever arm 13 in other suitable manners, as will be briefly explained hereinbelow and as apparent to a person skilled in the art.

The lever arm 13 is operable between first and second positions and each cam 15 has a contact surface 21 being positioned for operatively cooperating with a corresponding bulge 11. Prior to the bending operation, the extremity 3 of the torsional spring 5 is inserted between a given bulge 11 and the contact surface 21 of a corresponding cam 15 when the lever arm 13 is in the first position, as better shown in FIGS. 1–4. In operation, the extremity 3 of the spring 5 is bent about the bulge 11 by the contact surface 21 of the corresponding cam 15 when said contact surface 21 is urged towards the bulge 11 and forced about the same over the extremity 3 of the spring 5 as the lever arm 13 is operated into the second position, as better shown in FIGS. 5 and 6. It should be understood, as apparent to a person skilled in the art, that the shape and dimensions of each cam 15 are selected so that when the contact surface 21 of the cam 15 engages with the torsional spring 5, an upward pull of the lever arm 13 will result in friction between the cam 15 and the spring 5, and in an increase of the force by the contact surface 21 of the cam 15 onto the spring tail 3, i.e. according to the present invention, a cam effect combined with a lever effect is used to bend the spring tail 3 of the torsional spring 5.

As aforementioned, each cam 15 is preferably eccentrically mounted about its pivot axis. In doing so, the distance between the bulge 11 and the contact surface 21 of the corresponding cam 15 is slightly decreased, i.e. not constant, as the cam 15 is rolled over the extremity 3 of the spring 5 when the lever arm 13 is rotated about the flange 9. This feature enables namely to better force the extremity 3 of the spring 5 into its bent form against the bulge 11, as apparent to a person skilled in the art and as better shown in FIGS. 3–6. It is worth mentioning though that although the eccentricity of the cams 15 provides some advantages, as briefly described herein, it should be understood that this particular geometrical configuration and the particular shape of the cams 15 are not essential features of the invention. Indeed, the flange 9 with its corresponding bulge 11 and the lever arm 13 with its corresponding cam 15 may be interconnected differently so as to achieve the intended result of the device 1 according to the present invention, which essentially lies in forcing the extremity 3 of a torsional spring 5 to be bent against a corresponding bulge 11 of a flange 9 by the contact surface 21 of a cam 15 provided on a lever arm 13 by operatively urging the contact surface 21 of the cam 15 towards the bulge 11 and forcing the cam 15 over the extremity 3 of the spring 5 and about the bulge 11 as the lever arm 13 is rotated about the flange 9.

Preferably, the contact surface 21 of each cam 15 is knurled so as to improve "gripping" of the cam 15 onto the spring extremity 3 to be bent as it is rolled over the extremity 3 when the lever arm 13 is rotated.

As better shown FIGS. 1, 2 and 7–9, the device preferably comprises first and second flanges 9*a*,9*b* projecting from the base plate 7 and the lever arm 13 is preferably pivotally mounted between the flanges 9 about the shaft 17 extending through corresponding bores provided on the flanges 9.

Preferably, this shaft 17 has first and second ends protruding from the first and second flanges 9*a*,9*b* respectively. These first and second ends of the shaft 17 act as first and second bulges 11*a*,11*b* and the device 1 preferably further comprises first and second cams 15*a*,15*b*, each of said cams 15 being pivotally mounted on either side of the lever arm 13 about the shaft 19 extending through the corresponding bore provided on the lever arm 13, as better shown in FIGS. 1, 2 and 7. The first and second cams 15*a*,15*b* have each a contact surface 21 being positioned for operatively cooperating with the first and second bulges 11*a*,11*b* respectively, as better shown in FIG. 8.

By preferably having first and second cams 15*a*,15*b* cooperating with first and second bulges 11*a*,11*b* respectively instead of a sole cam 15 cooperating with a sole bulge 11, a single unit of the present device 1 may be used with torsional springs 5, irrespectively of whether or not the springs 5 are wound clockwise or counterclockwise. As can be easily understood, a corresponding side of the device 1 is used depending on how a given torsional spring 5 is wound. For example, in FIG. 1, the left side of the device 1 is used for bending the extremity 3 of a torsional spring 5 having been wound counterclockwise, while the right side of the device 1 would be used for bending the extremity 3 of a torsional spring 5 wound clockwise.

As better shown in FIGS. 1–8, the cams 15 are preferably provided with biasing means 23 for maintaining the cams 15 in a biased position with respect to the lever arm 13. The biasing means 23 preferably consist of a spring assembly which is operatively connected between the lever arm 13 and the cams 15 and which is devised to urge the cams 15 towards their corresponding bulges 11 at a predetermined distance thereof, as better shown in FIG. 3. As better shown in FIG. 4, the cams 15 may be drawn back from the bulges 11 by pulling back onto a handle 24 of the spring assembly so as to facilitate the insertion of a given spring tail 3 to be bent. Once the spring tail 3 is introduced and the spring assembly is released, the cams 15 are urged back onto the spring 5, as can be easily understood by referring to FIGS. 5 and 6. Furthermore, as can be easily understood by a person skilled in the art, the design of the cams 15 and of the biasing means 23 according to the present invention enable the device 1 to be used for bending extremities 3 of torsional springs 5 having different wire sizes, i.e. torsional springs 5 made of wires whose diameters are different, because the distance between a given bulge 11 and the contact surface 21 of a corresponding cam 15 may be adjusted accordingly.

Figure 10:
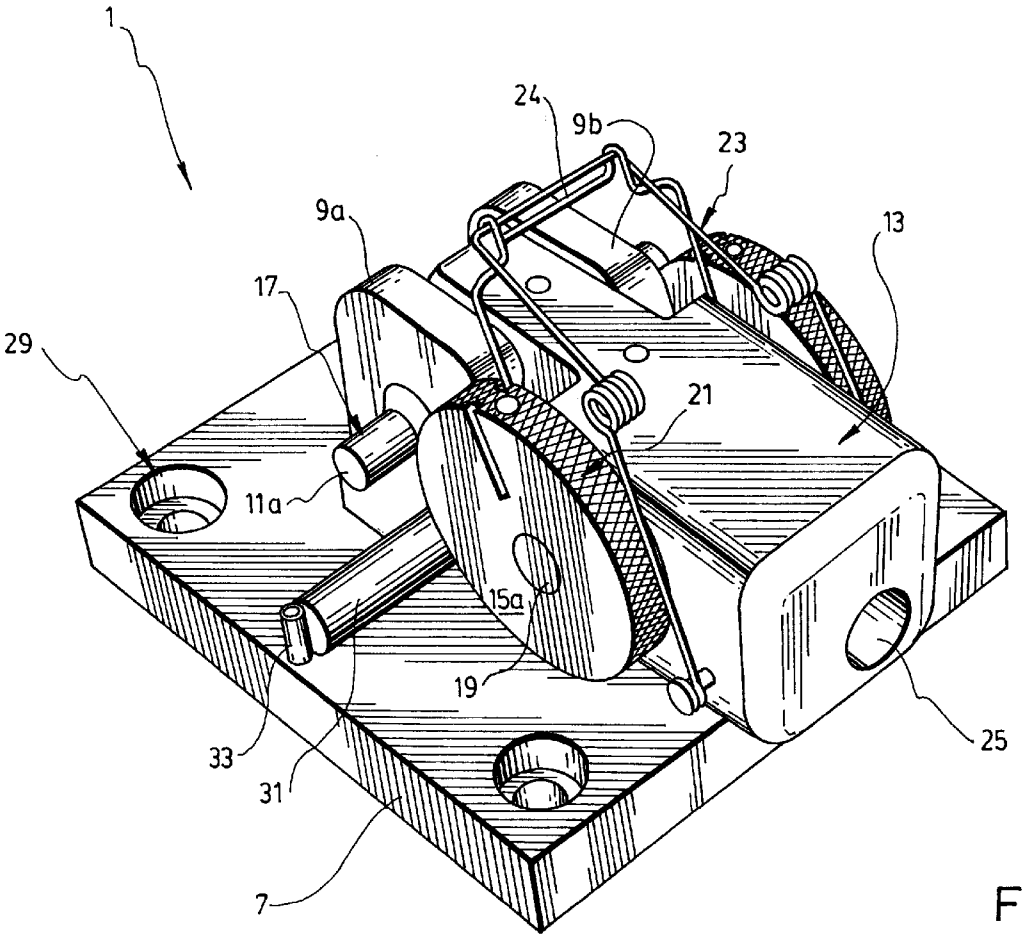
FIG. 10 is a rear perspective view of the device shown in FIG. 1, the device being shown without a winding bar and with the biasing means drawn back.
Figure 11:
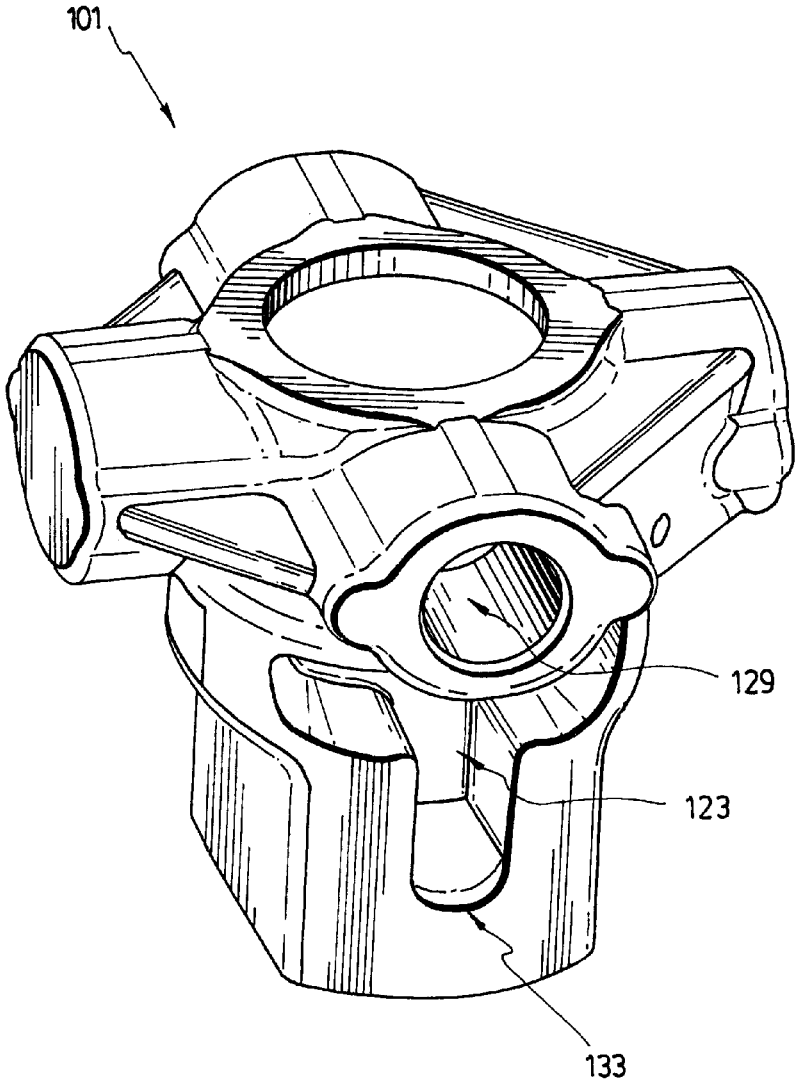
FIG. 11 ( PRIOR ART )
FIG. 11 is a perspective view of a winding plug according to the prior art.
Figure 12:
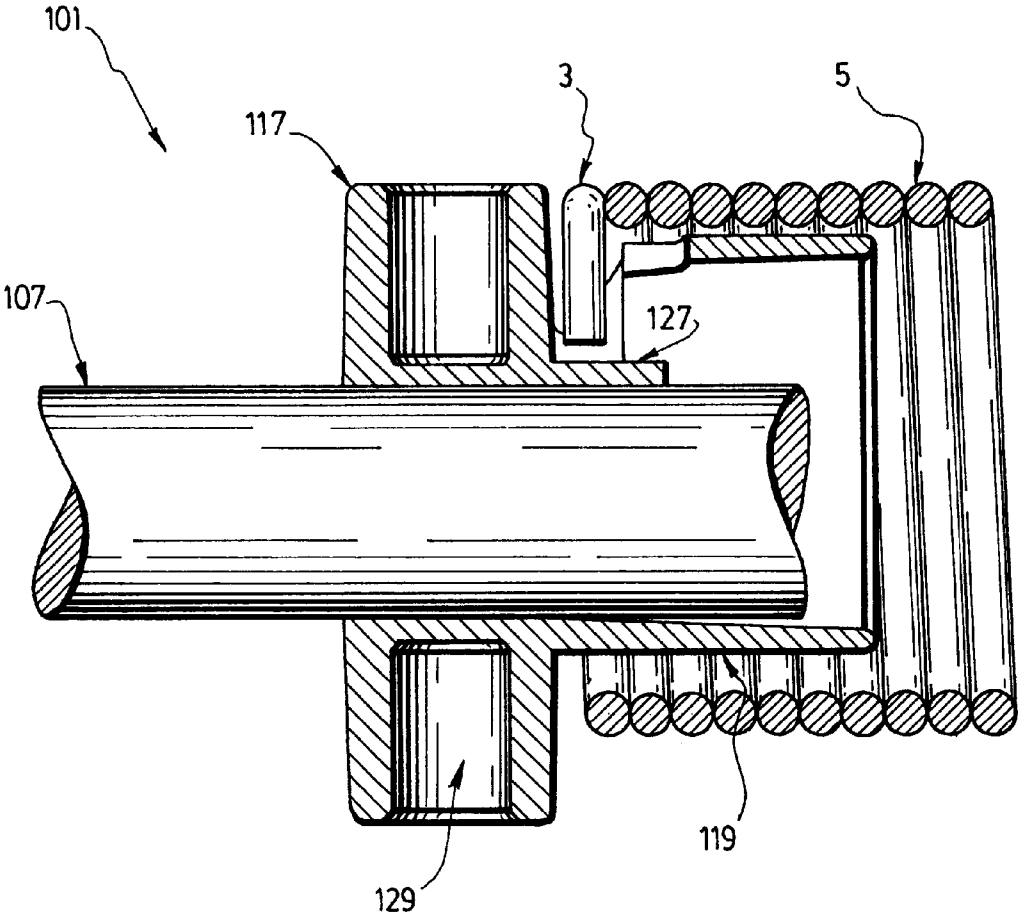
FIG. 12 ( PRIOR ART )
FIG. 12 is a cross-sectional view of a torsional spring hooked onto a winding plug which is mounted onto a shaft of a counterbalancing mechanism according to the prior art.

As better shown in FIG. 10, the lever arm 13 is preferably provided with a rear slot 25 for receiving a winding bar 27 so as to facilitate manual rotation of the lever arm 13 about the flanges 9 by using the winding bar 27 as an extended lever arm 13 of the device 1, as apparent to a person skilled in the art. Winding bars 27 are commonly used in the garage industry for winding plugs of counterbalancing mechanisms.

Preferably also, the base plate 7 is provided with at least one hole 29 for receiving a corresponding fastener so as to enable to securely mount the base plate 7 of the device 1 onto a fixed structure, such as a table or a service truck bumper for example, and provide the device 1 with greater stability when the lever arm 13 is actuated for bending a spring extremity 3, as apparent to a person skilled in the art. Alternatively, instead of mounting the device 1 onto a fixed structure, a sole base plate 7 with suitable dimensions may also be used for providing the device 1 with sufficient stability when the lever arm is actuated, as also apparent to a person skilled in the art.

As better shown in FIGS. 1, 2 and 7–9, the device 1 preferably further comprises a pin 31 projecting from each flange 9 and extending along the base plate 7. This pin 31 is preferably devised for acting as a guiding member for the torsional spring 5 and as a supporting member when its extremity 3 is being bent by the device 1. As better shown in FIGS. 4–6, one portion of the spring 5 preferably rests against the pin 31 while the extremity 3 of the spring 5 is forced and bent against the bulge 11. Preferably also, the dimensions of the device 1 and the disposition between bulge 11 and pin 31 are selected so that when the device 1 is used with a particular torsional spring 5, the bottom portion thereof rests against the pin 31, so as to allow the device 1 to operate properly, i.e. so as to allow the extremity 3 of the torsional spring 5 to be properly bent, as apparent to a a person skilled in the art.

Preferably also, the pin 31 is slidably movable along a corresponding bore provided on each flange 9 and the sliding of the pin 31 along its corresponding bores is preferably delimited by two opposite stoppers 33 provided on the base plate 7. Consequently, depending on which side of the device 1 is used to bend the extremity 3 of a given type of torsional spring 5, the pin 31 is slid accordingly in order to act as a guiding/supporting member for the spring 5 in the manner described hereinabove. Furthermore, the base plate 7 may also be provided with corresponding recesses (not shown) on either side of the flanges 9, the recesses extending longitudinally adjacent to the pin 31 for receiving and further supporting torsional springs 5 when their extremities 3 are bent.

As may now be appreciated, the present invention is a substantial improvement over the prior art in that it is an improved device 1 than what is known in the art for bending an extremity 3 of a torsional spring 5 destined to be employed with plugs of counterbalancing systems of garage doors and the like. Indeed, the device 1 according to the present invention is advantageous in that, as explained hereinabove, it enables to quickly and easily bend an extremity 3 of a torsional spring 5 in a particular manner so that the bent extremity 3 may have a suitable configuration so as to properly cooperate with a plug of a counterbalancing mechanism. Furthermore, the present invention is also a substantial improvement over the prior art in that, as described herein and as can be easily understood, it provides an easier, simpler and more cost effective way of bending an extremity 3 of a torsional spring 5, without requiring the use of heat for bending the spring tail, and may be easily transportable from one site to another so as to facilitate the work of a person installing, repairing or replacing the torsional spring 5 of a counterbalancing mechanism. Moreover, the present invention is also a substantial improvement over the prior art in that, as may be appreciated from the above-discussed, the device 1 can be used for bending the extremities 3 of torsional springs 5 having different wire sizes.

Of course, numerous modifications could be made to the above-described embodiments without departing from the scope of the invention as defined in the appended claims.

What is claimed is:

1. A device for bending an extremity of a torsional spring, the device comprising:

a base plate;

at least one flange projecting from the base plate;

at least one bulge projecting from the at least one flange;

a lever arm pivotally mounted onto the at least one flange about a first pivot axis, the lever arm being operable between first and second positions; and at least one cam pivotally mounted onto said lever arm about a second pivot axis, said at least one cam having a contact surface being positioned for operatively cooperating with said at least one bulge;

wherein the extremity of the torsional spring is inserted between the at least one bulge and the contact surface of the at least one cam when the lever arm is in the first position; and wherein said extremity is bent about the at least one bulge by the contact surface of the at least one cam when said contact surface is urged towards said at least one bulge and forced about the same over the extremity as the lever arm is operated into the second position.

2. A device according to claim 1, wherein the first pivot axis comprises a shaft extending through a corresponding bore provided on the at least one flange.

3. A device according to claim 1, wherein the second pivot axis comprises a shaft extending through a corresponding bore provided on the lever arm.

4. A device according to claim 1, wherein the device comprises first and second flanges projecting from the base plate, the lever arm being pivotally mounted between said flanges about a shaft extending through corresponding bores provided on the flanges.

5. A device according to claim 4, wherein the shaft has first and second ends protruding from the first and second flanges respectively, said first and second ends acting as first and second bulges; and wherein the device comprises first and second cams, each of said cams being pivotally mounted on either side of the lever arm about a shaft extending through a corresponding bore provided on the lever arm, the first and second cams having each a contact surface being positioned for operatively cooperating with the first and second bulges respectively.

6. A device according to claim 5, wherein the cams are provided with biasing means for maintaining the cams in a biased position with respect to the lever arm.

7. A device according to claim 1, wherein the device further comprises a pin projecting from the at least one flange and extending along the base plate.

8. A device according to claim 7, wherein the pin is slidably movable along a corresponding bore provided on the at least one flange.

9. A device according to claim 8, wherein sliding of the pin along its corresponding bore is delimited by two opposite stoppers provided on the base plate.

10. A device according to claim 1, wherein the lever arm is provided with a slot for receiving a winding bar.

11. A device according to claim 1, wherein the contact surface of the at least one cam is knurled.

12. A device according to claim 1, wherein the base plate is provided with at least one hole for receiving a corresponding fastener.

13. A device according to claim 1, wherein the at least one cam is eccentrically mounted about the second pivot axis.

14. A device for bending an extremity of a torsional spring, the device comprising:

a base plate;

first and second flanges projecting from the base plate;

first and second bulges projecting from the first and second flanges respectively;

a lever arm being pivotally mounted between the flanges about a first shaft extending through corresponding bores provided on the flanges, the first shaft having first and second ends protruding from the first and second flanges respectively, said first and second ends acting as the first and second bulges respectively, the lever arm being operable between first and second positions; and first and second cams, each of said cams being pivotally mounted on either side of the lever arm about a second shaft extending through a corresponding bore provided on the lever arm, each cam being eccentrically mounted onto the second shaft, the first and second cams having each a contact surface being positioned for operatively cooperating with the first and second bulges respectively;

wherein the extremity of the torsional spring is inserted between a given bulge and the contact surface of a corresponding cam when the lever arm is in the first position; and wherein said extremity is bent about the given bulge by the contact surface of the corresponding cam when said contact surface is urged towards said given bulge and forced about the same over the extremity as the lever arm is operated into the second position.

15. A device according to claim 14, wherein the cams are provided with biasing means for maintaining the cams in a biased position with respect to the lever arm.

16. A device according to claim 14, wherein the device further comprises a pin projecting from the flanges and extending along the base plate.

17. A device according to claim 16, wherein the pin is slidably movable along corresponding bores provided on the flanges, and wherein sliding of the pin along its corresponding bores is delimited by two opposite stoppers provided on the base plate.

18. A device according to claim 14, wherein the lever arm is provided with a slot for receiving a winding bar.

19. A device according to claim 14, wherein the contact surface of each cam is knurled.

20. A device according to claim 14, wherein the base plate is provided with at least one hole for receiving a corresponding fastener.

* * * * *